United States Patent [19]

Gorton

[11] 4,176,890

[45] Dec. 4, 1979

[54] DRAWER AND SUPPORT SYSTEM

[75] Inventor: Howard B. Gorton, San Gabriel, Calif.

[73] Assignee: Ajax Hardware Corporation, City of Industry, Calif.

[21] Appl. No.: 893,677

[22] Filed: Apr. 5, 1978

[51] Int. Cl.[2] ..... A47B 88/04

[52] U.S. Cl. ..... 312/343; 312/341 R; 312/347; 248/251

[58] Field of Search ..... 312/330 R, 343, 350, 312/341 R, 341 NR, 347, 348; 248/251, 261, 74, 73

[56] References Cited

U.S. PATENT DOCUMENTS

| | | | |
|---|---|---|---|
| 1,569,010 | 1/1926 | Geimer | 312/347 |
| 1,876,557 | 9/1932 | Bodenstein | 312/347 |
| 1,969,749 | 8/1934 | Harsh | 312/348 |
| 2,364,766 | 12/1944 | Balkind | 312/341 R |
| 2,747,943 | 5/1956 | Metcalf | 312/343 |
| 3,090,662 | 5/1963 | Dargene | 312/343 |
| 3,375,051 | 3/1968 | Anderson | 312/343 |
| 3,658,399 | 4/1972 | Vogt | 312/343 |
| 3,675,883 | 7/1972 | Holmes et al. | 248/251 |
| 3,726,579 | 4/1973 | Ullman, Jr. | 312/330 R |
| 3,750,993 | 8/1973 | Read | 312/343 |
| 3,876,270 | 4/1975 | White | 312/350 |
| 4,037,897 | 7/1977 | Siggia | 312/343 |

*Primary Examiner*—Victor N. Sakran
*Attorney, Agent, or Firm*—Dallett Hoopes

[57] ABSTRACT

Drawer is supported by system in which drawer side rails are provided with rollers which fit into U-shaped tracks, the rearward ends of which are supported vertically but are permitted lateral movement. Restraining means on the drawer keep the tracks in contact with the rollers. The system forgives errors and discrepancies in the squareness of the structure and inaccuracy of the mounting of rear supports. Also disclosed is a "wrapping" of the bottom portion of the drawer sidewall by the metal rail obviating glue and other fastening means.

4 Claims, 8 Drawing Figures

DRAWER AND SUPPORT SYSTEM

BACKGROUND OF THE INVENTION

1. Field of the Invention

This invention relates to a drawer and support system therefor. More specifically, this invention relates to a drawer provided with a pair of rails which engage tracks mounted in the cabinet, the tracks running from the drawer opening rearwardly to a ledge-like support on the rear wall of the cabinet. This rear support permits a "floating" support of the rear end of the tracks and permits lateral movement of the drawer.

The invention also includes means for securing the rail to the drawer comprising the "wrapping" of a lower portion of the drawer by the rail metal.

2. Description of the Prior Art

In the prior art, many cabinet crawers are supported by a rail on either side having rollers at the rearward end thereof. The rollers engage in metal tracks which are supported on the forward and rear cabinet structure portions. It has been a problem in the past that these tracks are not absolutely parallel and as a result the drawer has either wedged between the two tracks in its inward position making operation difficult, or the rail rollers have fallen off the tracks when the drawer is all the way in causing a locking of the drawer.

In one prior U.S. Pat. No. 3,675,883, which issued July 11, 1972 to Holmes et al and which was assigned by my assignee, a drawer is supported by a meritorious system including a track or slide having a rear bracket which permits lateral movement of the rear end of the track. No prior art of which Applicant is aware shows a pair of supporting tracks, both of which at their rear ends are mounted in floating fashion by the specific means employed under the present invention to assure the non-binding and non-derailment operation of the drawer. The means includes cup-like rear supports and retaining means on the drawer itself. The present system is simple in structure and readily assembled.

Also, in the prior art side rails, of course, generally have been secured to the drawers by threaded fasteners. This has proved to be inadequate in the case of wooden drawers made of thin wood walls in that the drawer walls have split or become unglued and the rails have otherwise become disengaged from the drawer.

SUMMARY OF THE INVENTION

Under the present invention, the drawer is supported on a pair of parallel tracks engaged by rollers at the ends of the drawer rails. The tracks are supported at their rail ends in cup-like brackets to provide a floating action. Means are provided on the rear of the drawer to keep the tracks in engagement with the rollers.

Further, the invention includes the securement of the rails to the drawer by the "wrapping" of rail metal about portions of the drawer adjacent the engagement of the drawer bottom wall with the sidewalls thereof. This "wrapping" provides the drawer, which may be of otherwise inexpensive wooden construction, with a smooth metal underside reducing the friction against the track and cabinet parts.

BRIEF DESCRIPTION OF THE DRAWINGS

Other features and objects of the invention will be apparent from the following description and the appended drawings, all of which show a non-limiting form of the invention. In the drawings:

FIGS. 6 and 7 are on a reduced scale as compared to FIG. 1 of a drawer and support system embodying the invention with portions broken to reduce the length thereof for convenience of illustration;

FIG. 7 is a view taken on line 7—7 of FIG. 6; and

DESCRIPTION OF THE PREFERRED EMBODIMENT

Figures 1, 2, 3, 4, 5:
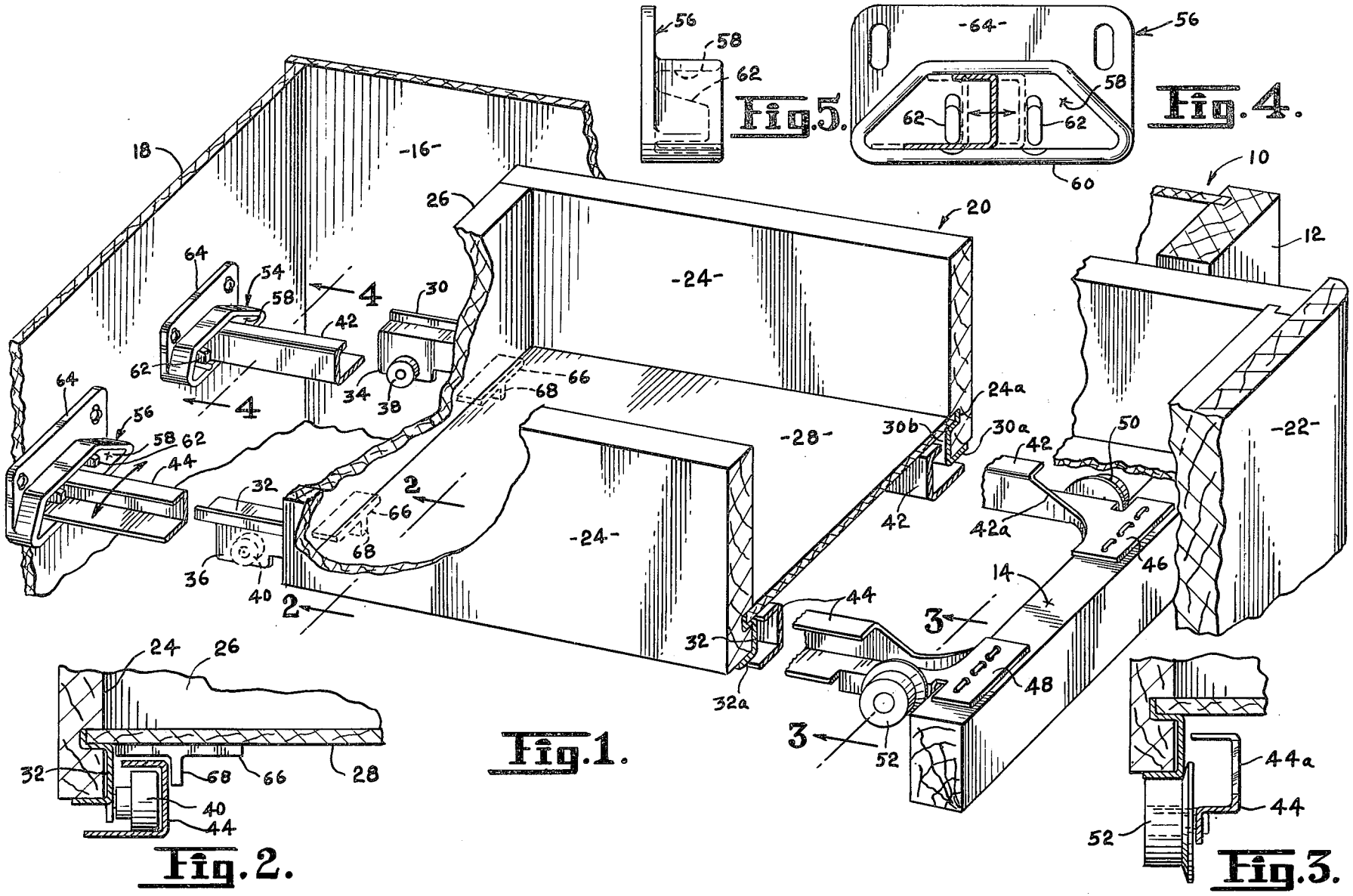
FIG. 1 is a perspective view with parts broken away to show structure of a drawer and support system embodying the invention.
FIG. 2 is an enlarged fragmentary sectional view taken on the line 2—2 of FIG. 1.
FIG. 3 is an enlarged sectional view taken on the line 3—3 of FIG. 1.
FIG. 4 is an enlarged sectional view taken on the line 4—4 of FIG. 1.
FIG. 5 is a side view of the rail support element shown in FIG. 4.
Figure 6:
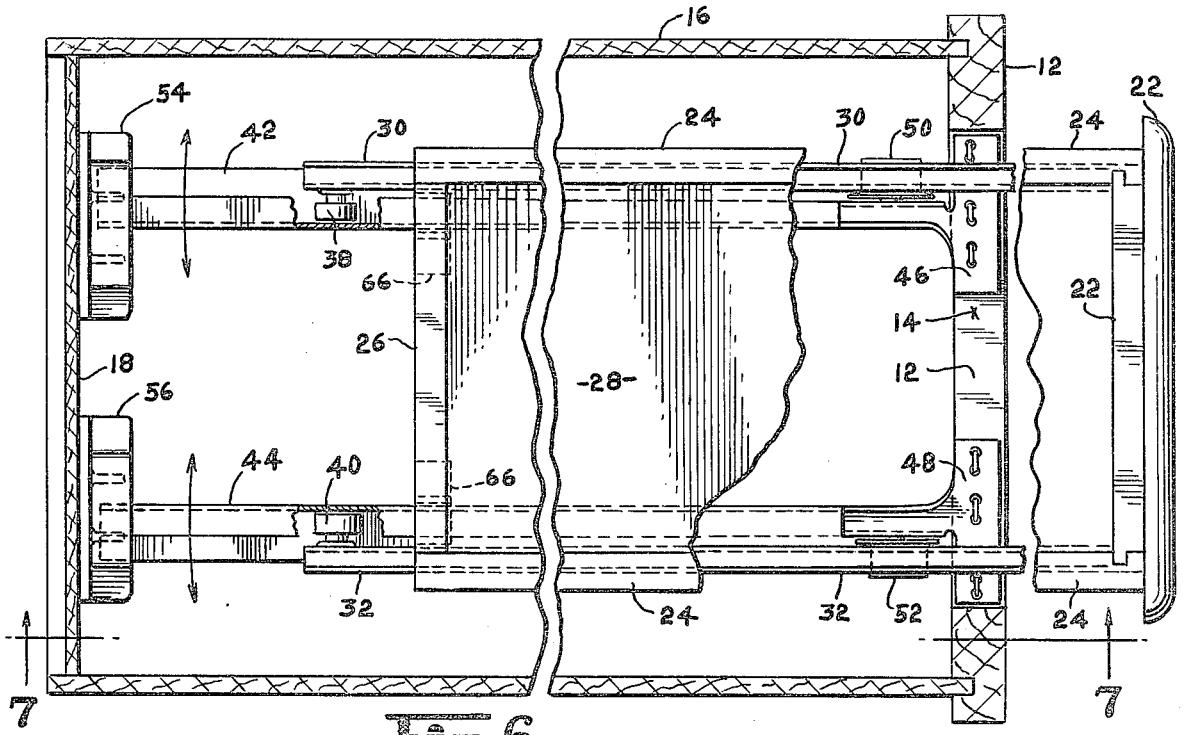
FIG. 6 is a section view on line 6—6 of FIG. 7.
Figure 7:
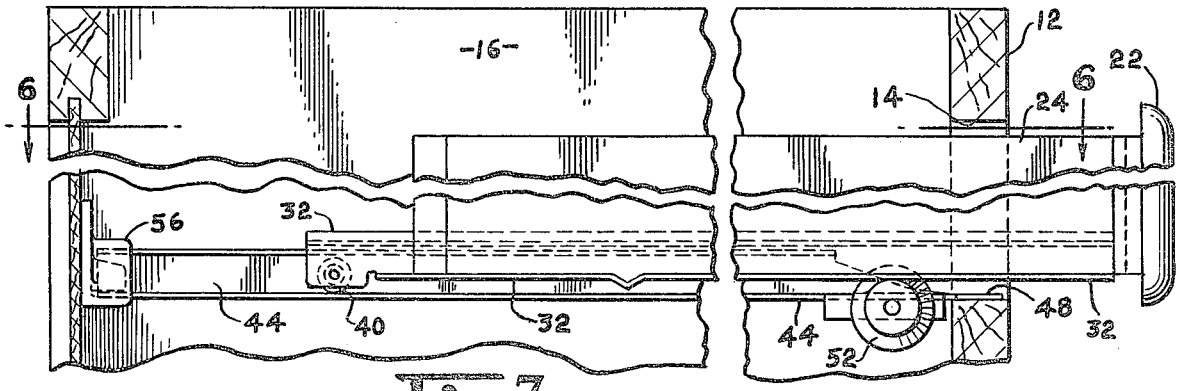

Referring more specifically to the drawings, a drawer and support embodying the invention is generally designated 10 in FIG. 1. It comprises a cabinet having a front wall 12 with an opening 14 for the drawer, a sidewall 16, and a rear wall 18. The drawing also shows a drawer generally designated 20 comprising a front wall 22, sidewalls 24, rear wall 26, and bottom wall 28. The various walls of the drawer are secured together in a more or less conventional manner with exceptions as will be explained.

Figure 8:
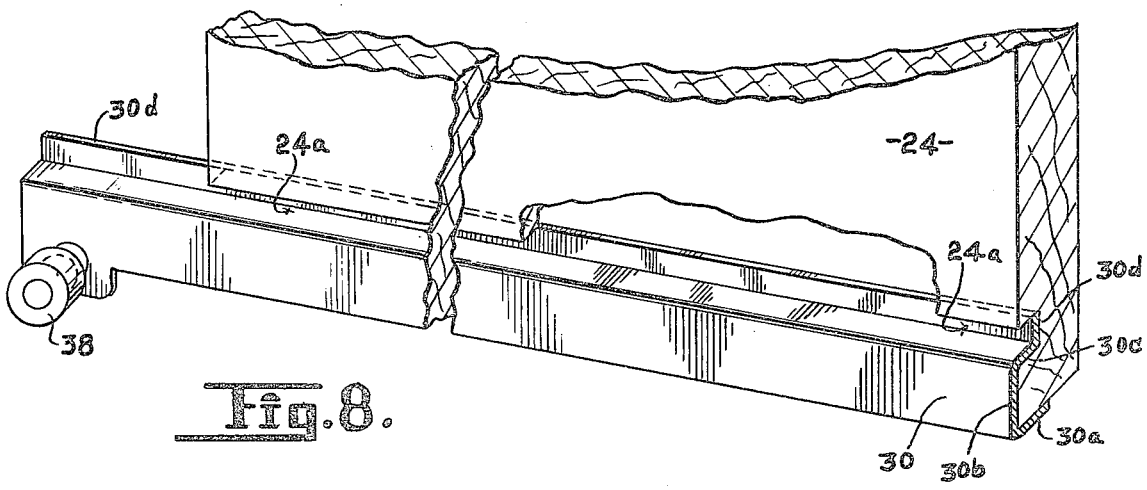
FIG. 8 is an enlarged view of a sidewall only and rail embodying a construction of the invention.

The support system for the drawer comprises a pair of rails 30 and 32. The rails generally comprise U-shaped elongate channel-shaped structures comprising (FIG. 8) a lower flange **30*a*, an intermediate web 30*b*, an upper flange 30*c*, and an upstanding lip 30*d*. As shown, these parts "wrap" about the lower portion of the sidewall 24 and extend into the dado 24*a* made for the adjacent edge of the bottom wall of the drawer (FIG. 1). This "wrapping" securely fastens the rail to the sidewall in a way which makes gluing unnecessary, and obviates the need for fasteners such as screws and the like which are normally used and which may well cause the splitting of the less expensive grades of wood used in the construction of the more popular furniture. As shown in FIG. 1, the rail 32 is "wrapped" about its sidewall in a fashion similar but reverse to the wrapping of the rail 30 about its sidewall. The rear ends of the rails are enlarged downward as at 34 and 36, and are formed there with inwardly directed shafts which journal the respective rollers 38, 40**.

Additional elements of the support system comprise the tracks 42, 44 which extend from front to back of the cabinet, or other housing in which the drawer moves. The tracks each comprise elongate U-shaped elements and are disposed with the openings of the U-shaped elements facing outwardly to receive the respective inward-facing rollers 38, 40 in operative engagement. As shown in FIG. 1, the forward ends of the tracks 42 and 40 are flattened to form mounting flanges 46, 48 which are perforated and stapled to the lower margin of the opening 14. Adjacent the front, the tracks are notched as at **42*a* and 44*a* and formed with downward flanges which mount shafts and cooperating flanged rollers 50 and 52. These rollers rollingly support the forward portions of the rails 30, 32, respectively. The notches 42***a* and 44*a* are large enough to provide clearance to permit entry of the rollers 38, 40 respectively.

The rearward ends of the tracks 42, 44 are received into cup-like members 54 and 56, respectively. The cups as shown in FIG. 4 are preferably formed with a trapezoidal opening 58 to accommodate either of the two rails 42, 44. The lower flanges of the rails rest on the ledge-like flange 60 and are permitted lateral movement therealong as designated by the arrows shown in dotted outline in FIG. 4. Stop elements 62 are provided to limit the lateral movement of the rails. The cup-like elements are provided with an apertured mounting flange 64, as shown.

The underside of the drawer (FIG. 2) is provided with restraining means 66 preferably secured to the underside of the rear wall 26. To hold the track 44, for instance, into engagement with the associated roller 40, preferably the restraining means 66 is in the shape of a T-shaped element having a downward flange 68 adapted to serve on either side of the drawer for the indicated purpose. Thus, while the rearward end of the tracks 42 and 44 are free, the restraining means 66 keep the tracks 42 and 44 parallel throughout the travel of the drawer.

Thus, once the drawer is maneuvered into position by causing the rearward ends of the rails 30, 32 to fit with their rollers into notches 42*a* and 44*a*, and is pressed all the way home until the flange on the front wall 22 hits the frame 12, the errors of alignment in the mounting of the rails and the placement of the rail supports 54, 56 as well as the inaccuracies and out-of-squareness of the drawer are all forgiven by virtue of the construction shown particularly including this restraining member 66 (FIG. 2). The rollers, 38, 40 assuredly contact the tracks 42, 44 and provide for the friction-free travel of the drawer. The smooth operating character of the drawer is enhanced by the engagement of the lower flange 30*a*, of the rails 30, 32 on the rollers 50, 52.

It should be understood that some variation may be made in the structure shown. For instance, the tracks 42, 44 may be of "L" shape, omitting the upper flange and still function with somewhat the same efficiency. The value of the upper flange of the tracks is, of course, to avoid the downward tipping of the drawer when the drawer is extended in its outward disposition. Also, the rearward supports 54, 56 may take various other shapes although the shape shown is preferred.

Thus, the invention is susceptible of changes to many variations still falling within the invention which may be defined in the following claim language.

I claim:

1. In a drawer and support system, the combination of a drawer having front and rear walls, a pair of sidewalls and a bottom wall, a pair of drawer rails secured along the lower end of the sidewalls respectively, the rails each having inwardly-facing rollers adjacent the rear wall, a drawer housing having a housing front wall formed with an opening to receive the drawer, and a housing rear wall spaced from and parallel to the front, a pair of elongate tracks having a U-shaped cross section, the tracks being disposed spaced and parallel and extending from the lower margin of the opening in the front housing frame to the rear housing wall, ledge means on the rear wall supporting the rear ends of the tracks against downward movement but permitting lateral movement, the tracks having their openings facing each other and receiving respectively the rollers, and means confining the tracks to respective locations where they respectively engage the rollers, each sidewall of the drawer being of non-metallic material and the inside surface of each having a groove therealong spaced up from the lower edge, the adjacent edge of the bottom wall extending into the groove, and the associated rail being sheet metal and having a portion which wraps around the bottom of the sidewall up the inside surface and into the groove beneath the bottom wall and to thereby be secured to the sidewall.

2. In a drawer and support system, the combination of a drawer having front and rear walls, a pair of sidewalls and a bottom wall, a pair of spaced drawer rails secured along the lower end of the drawer, the rails each having inwardly-facing rollers adjacent the rear wall, a drawer housing having a housing front wall formed with an opening to receive the drawer, and a housing rear wall spaced from and parallel to the front, a pair of elongate tracks having a vertical web and a horizontal flange, the tracks being disposed spaced and parallel and extending from the lower margin of the opening in the front housing frame to the rear housing wall, cup-shaped track support means on the rear wall having a substantially horizontal flat lower wall supporting the rear ends of the tracks against downward movement but permitting lateral movement, the tracks having their flanges extending toward each other and receiving respectively the rollers, and means adjacent the rear end of the drawer confining the tracks to respective locations where they respectively engage the rollers the means each comprising an element secured to the bottom of the drawer and having a downward projection adapted to engage the inner side of the associated track.

3. In a drawer and support system as claimed in claim 2, the combination wherein the element is shaped like the letter "T".

4. In a drawer and support system, the combination of a drawer having front and rear walls, a pair of sidewalls and a bottom wall, a pair of drawer rails secured along the lower end of the sidewalls respectively, the rails each having inwardly-facing rollers adjacent the rear wall, a drawer housing having a housing front wall formed with an opening to receive the drawer, and a housing rear wall spaced from and parallel to the front, a pair of elongate tracks having a U-shaped cross section, the tracks being disposed spaced and parallel and extending from the lower margin of the opening in the front housing frame to the rear housing wall, ledge means on the rear wall supporting the rear ends of the tracks against downward movement but permitting lateral movement, the tracks having their openings facing each other and receiving respectively the rollers, and means confining the tracks to respective locations where they respectively engage the rollers, the ledge means comprising a pair of cup-shaped elements facing the drawer and secured to the rear housing wall, the openings of the elements receiving respectively the rear ends of the rails and the elements each having lower portions in the same horizontal plane.

* * * * *